United States Patent [19]

Zapf et al.

[11] 4,362,336

[45] Dec. 7, 1982

[54] SLIDING CHAIR

[75] Inventors: Otto Zapf, Herzog-Adolph-Str. 5, 6240 Königstein, Fed. Rep. of Germany; Josef Kuchinke, Oberusel, Fed. Rep. of Germany

[73] Assignee: Otto Zapf, Konigstein, Fed. Rep. of Germany

[21] Appl. No.: 130,136

[22] Filed: Mar. 13, 1980

[30] Foreign Application Priority Data

Apr. 7, 1979 [DE] Fed. Rep. of Germany ..... 2914200
Apr. 26, 1979 [DE] Fed. Rep. of Germany ..... 2916897

[51] Int. Cl.[3] ..... A47B 1/023

[52] U.S. Cl. ..... 297/317; 297/61; 297/343

[58] Field of Search ..... 297/317, 318, 61, 83, 297/84, 330, 353, 343, 342, 341, 340, 409, 417; 296/65 R

[56] References Cited

U.S. PATENT DOCUMENTS

| | | | |
|---|---|---|---|
| 154,981 | 9/1874 | Fritche . | |
| 763,656 | 6/1904 | Bennett . | |
| 1,026,074 | 5/1912 | Cain | 297/317 X |
| 1,714,936 | 5/1929 | Warner | 297/318 |
| 1,789,337 | 1/1931 | Knabusch et al. . | |
| 1,928,857 | 10/1933 | Kelly . | |
| 2,271,925 | 2/1942 | Niles | 297/317 |
| 2,374,848 | 5/1945 | Wohlk | 297/343 |
| 2,462,521 | 2/1949 | Marriot . | |
| 2,981,314 | 4/1961 | Eklöf | 297/284 X |
| 3,224,808 | 12/1965 | Spielman | 297/341 |
| 3,567,280 | 3/1971 | Bradshaw . | |
| 3,572,829 | 3/1971 | Malitte | 297/317 |
| 4,209,198 | 6/1980 | Apple | 297/441 X |
| 4,291,913 | 9/1981 | Kowalski | 297/317 X |

FOREIGN PATENT DOCUMENTS

| | | |
|---|---|---|
| 7720527 | 12/1978 | Fed. Rep. of Germany . |
| 1078676 | 5/1954 | France . |

*Primary Examiner*—James T. McCall
*Attorney, Agent, or Firm*—Robert Scobey

[57] ABSTRACT

A chair type article of furniture has a seat member which is movable generally horizontally and a back rest which is supported at a lower portion thereof for generally horizontal movement with the seat member and is also articulated to the frame of the article of furniture at a location above the lower portion thereof for rearward reclining when the seat member moves forwardly. An improved support is provided for the lower back region of a seated person, including a back plate positioned forwardly of the back rest, a lower portion of the back plate being supported for generally horizontal movement with the seat member, and the back plate being supported by the back rest at a location above the lower portion of the back rest for rearward reclining of the back plate when the back rest reclines rearwardly.

8 Claims, 2 Drawing Figures

SLIDING CHAIR

Figure 1:
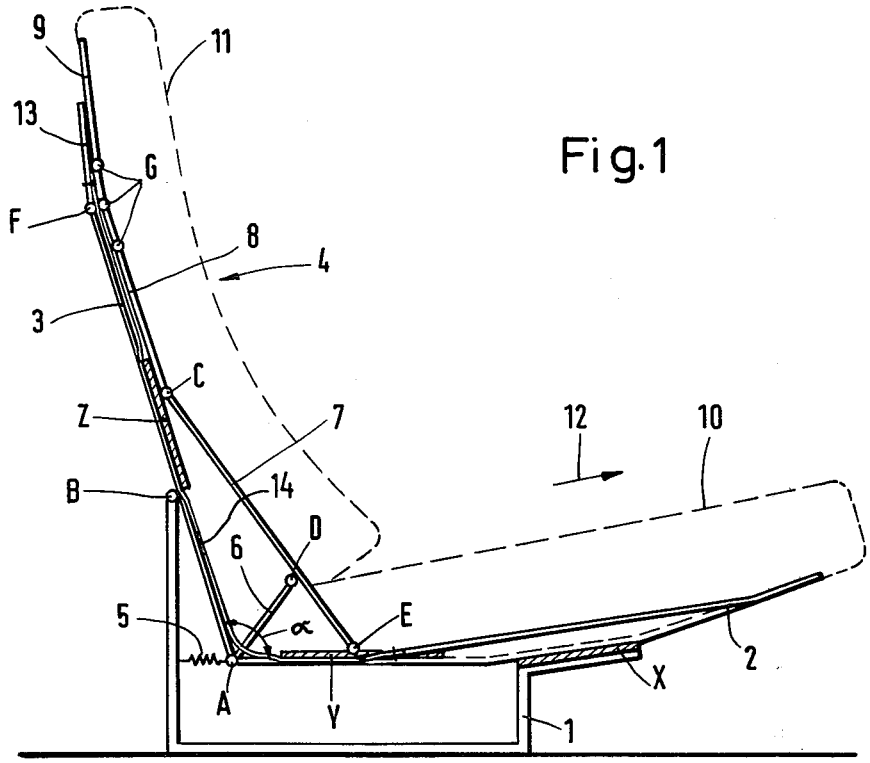

The invention relates to chair type furniture having a frame, a seat area and a back rest, the seat area being displaceable relative to the frame forward and backward, and with it the back rest articulated to it, which is pivotably mounted on the frame, wherein on the front of the back rest an anterior back-plate is provided, which is displaceable relative to the back rest.

Such a chair is known from French patent specification No. 1,078,676. Its distinguishing feature is that the user of the chair can change his position on the chair by pushing the seat area more forward or backward as desired, at the same time causing the inclination of the back rest to become more horizontal or more vertical.

In the case of said known chair, upon displacement of the seat area forward and simultaneous reduction of the inclination of the back rest, a force is exerted between the anterior back-plate and the contacting clothing of the respective person in a direction such that these garments are pulled upward in the person's back. Naturally this unpleasant pull is felt even more when upholstered furniture is involved, because upholstery is known to have an especially high friction on garments. Another disadvantage of this known chair is that the lumbar region is insufficiently supported during the displacement despite said pivoting of the back rest.

The invention avoids these disadvantages. Its object is to propose chair type furniture of the above mentioned kind which, while retaining said advantages, namely the possibility of the substantially horizontal displacement of the seat area forward and back with simultaneous change of inclination of the back rest, is distinguished in that with good support of the lumbar region there do not occur during this displacement any forces which tend to pull or push the clothing of the respective person upward or down in the region of the person's back.

Proceeding from a chair of the above mentioned kind, this is achieved according to the invention in that the anterior back-plate has in its central region a joint extending substantially horizontally, and is guided substantially horizontally at its lower edge.

With said displacement movement, therefore, the back rest is pivoted together with the seat area and at the same time the anterior back-plate displaceably disposed on it is shifted relative to the back rest, so that the mentioned disadvantageous forces can no longer occur. Upon this displacement an increasing area in the region of the joint between seat area and back rest is filled up by the anterior back-plate, so that thereby the lumbar region of the respective person is very well and constantly supported over the entire displacement path. Above said horizontal joint of the anterior back-plate the latter is prolonged farther upward, so that the anterior back-plate extends at least to the level of the back rest, which therefore is completely covered toward the user. The anterior back-plate may moreover extend upward beyond the back rest.

It serves to facilitate the displacement movement at simultaneous good conduction of the anterior back-plate and possibly of the seat area if guides are provided at the back rest for the anterior back-plate in the region of the joint thereof, at the frame for the lower edge of the anterior back-plate, and/or at the frame for the seat area.

With said displacement also the anterior back-plate shifts forward or back together with the seat area. It serves to perceptibly improve the conduction of the anterior back-plate below its joint if a web articulatedly connects the common joint between the seat area and the back rest, on the one hand, with the anterior back-plate, on the other. Upon said displacement of seat area and anterior back-plate, the web displaces, automatically as it were, the section of the anterior back-plate present below the joint relative to the frame in the desired manner.

The forces to be exerted are especially slight if the joint is disposed between the web and the anterior back-plate spaced from the lower edge of the anterior back-plate, as is preferred. The conditions are here preferably chosen so that in the neutral position of the chair the web forms an approximately right angle with the anterior front-plate.

Another preferred feature is to have a spring element connect the frame with the seat area, which spring element pulls the seat area into the neutral position. Instead of this, however, a pressure element may be provided, which pushes the seat area into the neutral position or into the starting position.

If the novel chair has a head support, the inclination thereof is likewise adjusted, the back rest and the anterior back-plate being articulated in the neck region for this purpose and a strap connecting the seat area with the topmost portion of the back rest. The strap is preferably a steel band. Upon displacement of the seat area forward, the strap, which is preferably provided on both sides, pulls the topmost portion of the seat area forward likewise, so that the substantially perpendicular arrangement of this topmost portion is essentially retained during the displacement. The same pivotal movement is imparted also to the topmost portion of the anterior back-plate.

In the following the invention will be explained in greater detail with reference to an embodiment, from which further important features will be evident.

Figure 2:
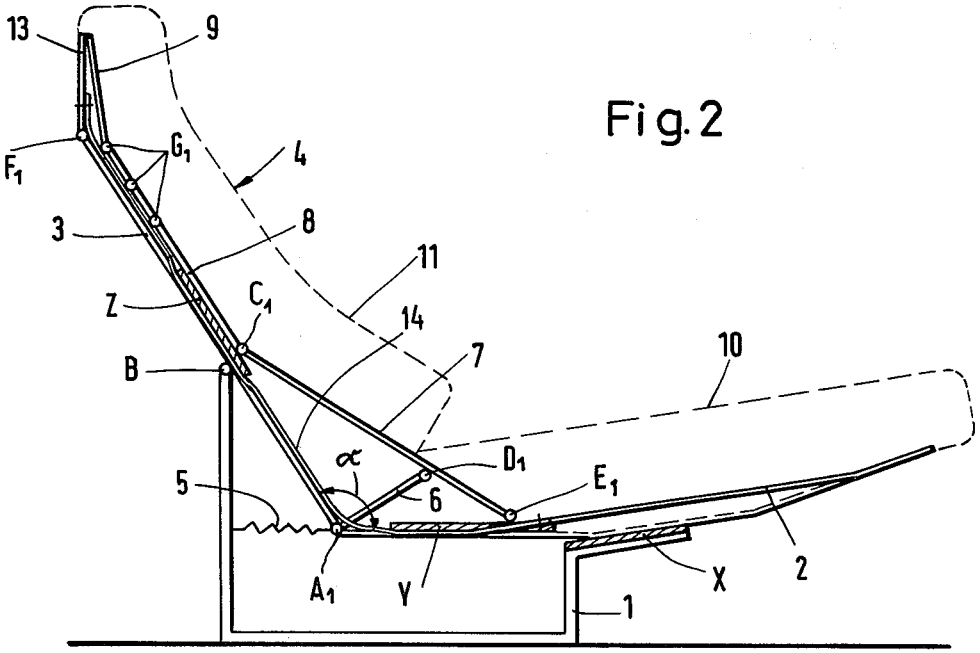

FIG. 1 shows the essential structural elements of novel chair type furniture in a side view partly in section, namely in the starting position of the chair;

FIG. 2, the situation of FIG. 1, the seat area being displaced forward, with reclining back rest.

The drawing shows an easy chair with head support without arm rests. The described principles are applicable just as well to a chair or other sitting furniture, for example an airplane seat, motor vehicle seat, easy chair, etc. with or without arm rests.

The novel chair consists of a frame 1, a seat area 2, a back rest 3, and an anterior back-plate 4 on the front side of the back rest. A guide rail X extends substantially horizontally and guides the seat area 2 at the frame 1. Another guide rail Y guides the rear region of the seat area 2 and the anterior back-plate 4. Still another guide rail Z extends in the region of a joint C of the anterior back-plate 4 and guides the latter at the back rest 3.

An extension spring 5 connects the frame with a joint A, which connects the lower part of the back rest 3 with the rear part of the seat area 2. At this joint A there engages further a web 6, whose other end is fastened to a joint D at the lower part of the anterior back-plate 4. In the starting position (see FIG. 1) web 6 forms approximately a right angle with the lower part of the anterior back-plate.

The anterior back-plate thus consists of several parts, namely a lower part 7, formed beween a joint E and the joint C. Joint E is formed at the lower edge of the anterior back-plate and is guided along guide rail Y. In addition, the anterior back-plate consists of a middle part 8 and one or more upper parts 9, which are connected together through one or more joints G. The upper part 9 is provided when the chair has a head support.

In that case also the rear back rest 3 is prolonged in an upper part 13, which is articulated to the rear back rest 3 through a joint F.

In addition there are indicated in the figures paddings 10 for the seat area and 11 for the back rest with backplate. If by the body movement of a person sitting on the chair the seat area 2 with pad 10 is pulled forward in the direction of arrow 12, joint A of FIG. 1 shifts to the location A1 of FIG. 2. The spring 5 is extended. Thereby the rear back rest 3 rotates about joint B, by which it is articulated to frame 1. The angle alpha between seat area 2 and rear back rest 3 increases. At constant distances between joints A–D and D–E, joint E must move to E1 (FIG. 2) when this angle alpha increases. Owing to this, the joints C and D necessarily move respectively to C1 and D1. With that there results a continuous support of the lumbar region by means of the lower part 7, which is moved up.

By a cable 14, in the form of a steel band, connected on the one hand with the topmost part 13 of the rear back rest 3 and, on the other, with the seat area 2, there is achieved during the movement a continuous support in the head region, which substantially retains its position relative to frame 1.

The described movement forward and back can be accomplished by a corresponding body movement only, without actuation of levers or buttons. Any existing arm rests are not involved in the described design because the back rest 3 is pivotably mounted on frame 1 through joint B. Instead it suffices to connect the arm rests with frame 1 in the usual manner.

The spring cable 5 holds the chair, when not occupied, in the upright position shown in FIG. 1.

If a covering exists, its rear portion is stitched in transverse pipes and provided with rubber bands perpendicular thereto or otherwise made elastic at least in the direction of arrow 12 (direction of movement).

We claim:

1. In a chair type article of furniture in which a seat member is movable generally horizontally and is articulated to a back rest which is supported at a lower portion thereof for generally horizontal movement with said seat member and is also articulated to the frame of said article of furniture at a location above said lower portion thereof for rearward reclining thereof when said seat member moves forwardly, the improvement comprising a back plate positioned forwardly of said back rest, a lower portion of said back plate constituting a support for the lumbar region of a person sitting on the furniture and being supported for generally horizontal movement with said seat member, said back plate being supported by said back rest at a location above said lower portion of said back rest for rearward reclining thereof when said back rest reclines rearwardly from an upwardly directed and non-reclining position to provide support for said lumbar region of a seated person, said back plate being divided by a pivotal joint into upper and lower back plate sections, and guide means between said back rest and said back plate for allowing relative movement between said back rest and said back plate in the general direction of movement of said seat member.

2. An article of furniture according to claim 1, in which said guide means comprises a guide rail for supporting said back plate.

3. An article of furniture according to claim 2, in which the lower portion of said back rest is pivotally connected to the rear of said seat member, and a web articulatedly connects said pivotable connection to an intermediate point on said lower back plate section.

4. An article of furniture according to claim 3, in which said web forms generally a right angle with said lower back platesection in a non-reclined position of said back rest.

5. An article of furniture according to claim 4, in which a spring connects said frame with said seat member and pulls said seat member into a neutral position in which said back rest is in said non-reclined position.

6. An article of furniture according to claim 5, in which said back rest and said back plate are articulated in the neck region of a seated person, and including a strap connecting said seat member with the uppermost portion of said back plate so that, when said seat member is moved forwardly, said uppermost portion of said back plate tilts forwardly.

7. An article of furniture according to any of claims 1 to 3, including a cover which encloses said seat member and said back rest and said back plate and the paddings thereof, the rear portion of said cover being made of elastic material.

8. An article of furniture according to claim 1, in which said lower portions of said back rest and back plate are not parallel to each other.

* * * * *